United States Patent [19]

Miyano

[11] 4,391,538

[45] Jul. 5, 1983

[54] SERIAL PRINTER

[75] Inventor: Hiroshi Miyano, Yokohama, Japan

[73] Assignee: Alps Electric Co., Ltd., Tokyo, Japan

[21] Appl. No.: 285,299

[22] Filed: Jul. 20, 1981

[30] Foreign Application Priority Data

Jul. 22, 1980 [JP] Japan ..... 55-100409

[51] Int. Cl.[3] ..... B41J 1/30

[52] U.S. Cl. ..... 400/145.1; 101/93.19; 400/174

[58] Field of Search ..... 400/142, 145, 145.1, 400/174, 144.2, 144.3, 145.2, 175; 101/93.19

[56] References Cited

U.S. PATENT DOCUMENTS 2,236,663 4/1941 Adams ..... 400/144.2
3,613,856 10/1971 Reed ..... 400/142
3,760,925 9/1973 Bossi ..... 400/144.3
3,985,218 10/1976 Gerry ..... 400/145.1
4,244,291 1/1981 Kodaira et al. ..... 101/99

FOREIGN PATENT DOCUMENTS 2922170 12/1980 Fed. Rep. of Germany ..... 400/174

*Primary Examiner*—Paul T. Sewell
*Attorney, Agent, or Firm*—Guy W. Shoup; Gerard F. Dunne

[57] ABSTRACT

A serial printer having a carriage, a disc-shaped type wheel rotatably carried by said carriage and adapted to be moved transversely of a paper, dome-shaped resilient supporting members covering a plurality of apertures formed in the periphery of said type wheel, type characters attached to respective supporting members, and hammer means adapted to press selected one of said type on said paper. The rotation of the type wheel, driving of the hammer and the shifting of the carriage can be achieved by one D.C. motor which acts in one direction continuously.

12 Claims, 7 Drawing Figures

SERIAL PRINTER

BACKGROUND OF THE INVENTION

The present invention relates to a serial printer and, more particularly, to a serial printer of the type in which a disc-shaped carrier carrying a multiplicity of type elements is moved in the line and column directions, and the type element of the desired character is forced out from the plane of the carrier to effect a printing on a recording paper.

An electronic printer having a type wheel having a plurality of spokes having respective type elements on their ends is known for use as a serial printer of the type mentioned above, and is generally referred to as a printwheel. In such known printers incorporating a printwheel, the shifting of the carriage and the rotation of the printwheel are typically controlled by different motors. Also, the carriage necessitatingly carries a hammer assembly and a large-sized electromagnetic hammer actuating means. In consequence, the size of the carriage is increased impractically resulting in an increased size and raised cost of the printer as a whole. Thus, this known serial printer is not suitable for use in combination with small-sized desk-top type calculator and the like.

On the other hand, there is an increasing demand for a desk-top type calculator incorporating such printing means, as a result of the diversification of the functions of the desk-top type calculators. From a commercial point of view, the printing device for use in the desk-top type calculator is preferably an impact type serial printer which has various advantages such as clean printing, simple construction and capability of printing on ordinary paper.

To meet this demand, a serial printer in which the selection of type, driving the hammer and shifting the carriage are performed by a common motor, such as, for example, is described in the U.S. Pat. Appln. Ser. No. 166,774 (filed July 8, 1980) and U.S. Pat. Appln. Ser. No. 178,891 (filed Aug. 8. 1980) has been proposed. These serial printers, although compact and lightweight, have a problem that, because the printing is effected on a paper interposed between a type ring and the hammer, the printing is sufficiently made only on a thin paper such as a rolled paper but cannot be made successfully on the comparatively thick paper such as cards, envelopes or the like. In addition, noise is inevitably produced as a result of the contact between the type ring and the hammer.

SUMMARY OF THE INVENTION

Accordingly, an object of the invention is to provide a small-sized light-weight printer which can suitably be used in small-sized desk-top type calculator.

Another object of the invention is to provide a less expensive serial printer having reduced number of driving sources.

Still another object of the invention is to provide a small-sized printer capable of effecting a printing even on a comparatively thick paper such as cards, envelopes or the like.

A further object of the invention is to provide a flat serial printer.

A still further object of the invention is to provide a printer which can provide a high quality of printing at a reduced level of noise.

BRIEF DESCRIPTION OF THE DRAWINGS

FIG. 2(*b*) is a side elevational view of the type wheel;

FIG. 2(*c*) is a back side view of the type wheel;

DESCRIPTION OF THE PREFERRED EMBODIMENTS

Figure 1:
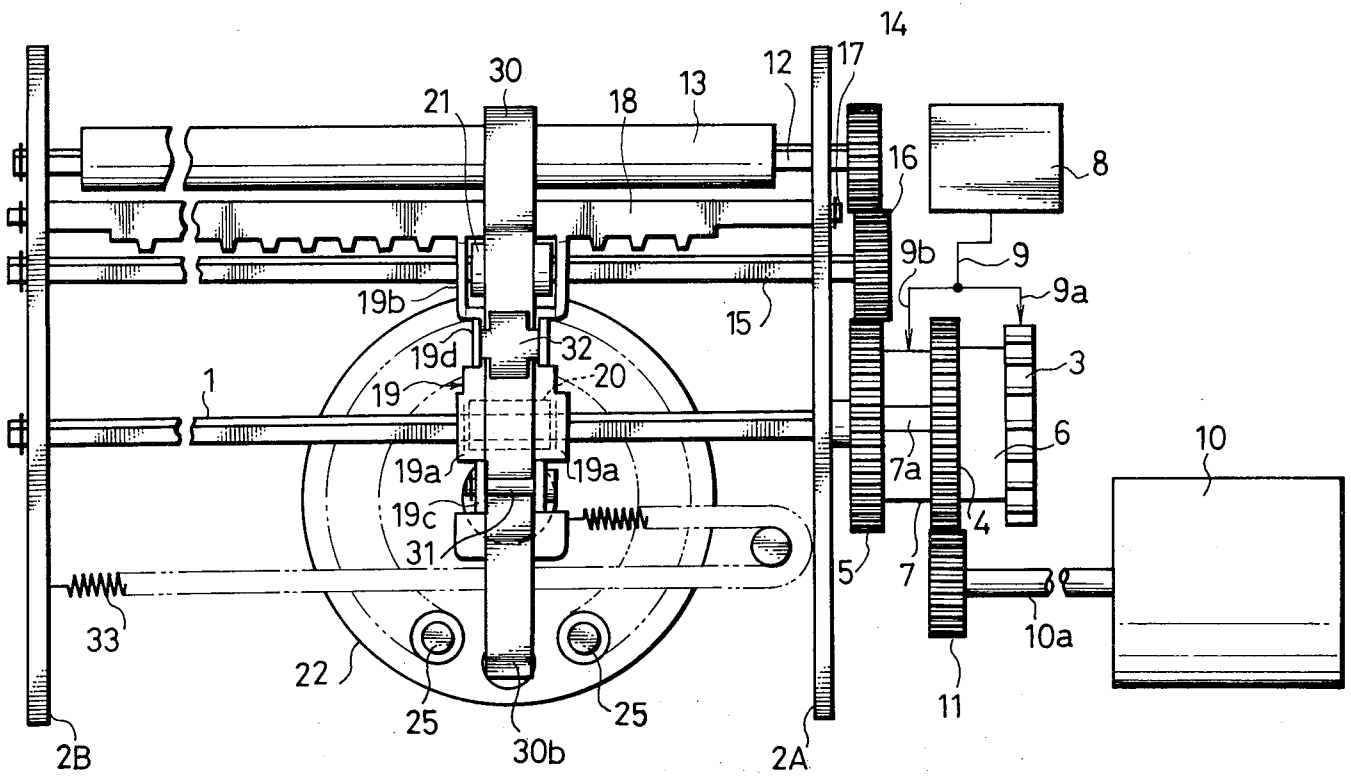
FIG. 1 is a partly simplified plan view of a serial printer in accordance with the invention.

Referring to the drawings, a reference numeral 1 denotes a type wheel shaft rotatably extended between a pair of frame members 2A,2B. The type wheel shaft 1 projects by a predetermined amount to the right side of the frame member 2A. A ratchet 3 is fixed to the projected portion of the type wheel shaft. Also, gears 4 and 5 are secured to the projected portion of the type wheel shaft 1 in such a manner so as to be rotatable independently of each other. A reference numeral 6 designates a first clutch means disposed between the gear 4 and the ratchet 3, i.e. the type wheel shaft 1, and is adapted to transmit a power between the gear 4 and the ratchet 3. A second clutch means 7 having a peripheral cam groove 7*a* is disposed between the gears 4,5 to control the transmission of power between these gears 4,5. A reference numeral 8 denotes a solenoid adapted to drive an operation rod 9 for controlling both clutch means 6,7. The operation rod 9 has one end 9*a* engageable with the ratchet 3 and the other end 9*b* engageable with the cam groove 7*a*. The arrangement is such that, when the one end 9*a* of the operation rod is in engagement with the ratchet 3, the other end 9*b* is out of the engagement with the cam groove 7*a*. To the contrary, when the other end 9*b* is in engagement with the cam groove 7*a*, the one end 9*a* is out of engagement with the ratchet 3. Thus, the operation rod 9 functions as a mechanical flip-flop. Thus, when the operation rod 9 is engaged by the cam groove 7*a*, the gear 4 and the type wheel shaft 1 (ratchet 3) rotate unitarily with each other, while the gears 4,5 are disconnected from each other, whereas, when the operation rod 9 is engaged by the ratchet 3, the gears 4,5 rotate unitarily with each other but the gear 4 is disconnected from the type wheel shaft 1. If necessary, reference can be made to the preceding application, U.S. Patent Appln. Ser. No. 178,891; filed Aug. 8, 1980 in which details of this and other mechanisms described herein are set forth.

A reference numeral 10 designates a D.C. motor having a shaft 10*a* adapted to rotate only in one direction. A gear 11 attached to this shaft 10*a* meshes with the gear 4, so that the rotation of the motor 10 is selectively transmitted to the type wheel shaft 1 or to the gear 5 through the medium of the gear 4.

A reference numeral 12 designates a hammer drive shaft rotatably carried and extended between the frame members 2A,2B. This hammer drive shaft 12 carries a hammer driving cam 13 which has a length corresponding to the width of one line of printing. A reference numeral 14 designates a gear attached to the end of the hammer drive shaft 12 and adapted to mesh with a later-mentioned gear 16. A column shift shaft 15 for shifting a later-mentioned carriage rotatably carried and extended between the frame members 2A,2B has a non-circular cross-section, and carries at its one end a gear 16 which meshes with the gear 5.

A reference numeral 17 designates a rack shaft held between the frame members 2A,2B for a rotation by a predetermined rotation angle, and carries a rack 18 fixed thereto and adapted to shift the carriage.

The carriage designated by a numeral 19 generally has an elongated tubular form and is provided at its intermediate portion with inwardly bent attaching pieces 19*a*,19*a* (See FIG. 3) having circular holes (not shown) receiving the type wheel shaft 1. Thus, the carriage 19 is slidable along the type wheel shaft 1 but does not rotate therewith. A reference numeral 20 designates a first worm clamped between the attaching pieces 19*a*,19*a* (only partly shown) and splined to the type wheel 1. Thus, the first worm can slide in the axial direction along the shaft 1 but is prevented from rotating relatively to the latter. The first worm 20 is shifted together with the carriage 19 and acts to transmit the rotation of the type wheel shaft 1 to a later-mentioned type wheel or carrier.

A second worm 21 is held by attaching pieces 19*b*,19*b* inwardly bent from one end of the carriage 19. The attaching pieces 19*b*,19*b* hold the second worm 21 rotatably in such a manner so as not to drop from these attaching pieces 19*b*,19*b*. This second worm 21 is splined to the aforementioned column shift shaft 15. The aforementioned rack 18 engages with the teeth of the second worm 21 exposed from the lower side of the attaching pieces 19*b*,19*b*. Although not shown, the second worm 21 has teeth which extend in the circumferential direction over a half circumference of the worm body while the residual part of the teeth are formed spirally. Therefore, the spiral teeth of the worm 21 do not engage with the teeth of the rack 18 during the earlier half part of the rotation of the column shift shaft 15, but the spiral teeth engage the rack 18 during the later-half of the rotation of the column shift shaft 15 to shift the worm 21 and, hence, the carriage 19 by a distance corresponding to one pitch along the column.

Figure 3:
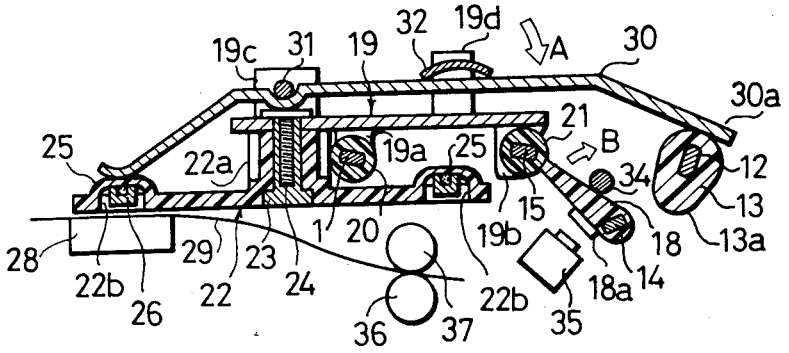
FIG. 3 is a partly simplified right-side sectional view showing a hammer driving mechanism and a carriage shifting mechanism.

A reference numeral 22 designates a type carrier or wheel rotatably carried by the end of the carriage 19 opposite to the second worm 21, as will be seen from FIG. 3.

The type carrier 22 has a worm gear 22*a* formed at the mid portion thereof and meshing with the first worm 20. A reference numeral 23 designates a support shaft for supporting the type carrier 22 on the carriage 19, while a reference numeral 24 designates a screw member.

Figure 2A:
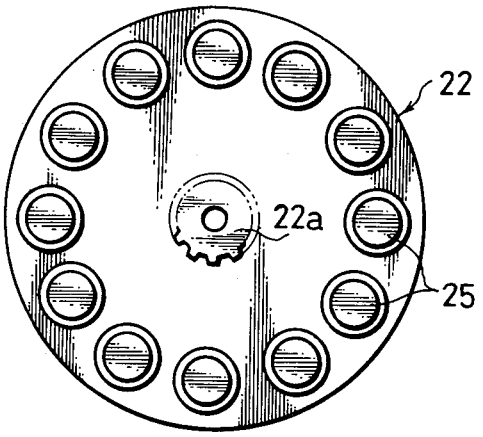
FIG. 2(*a*) is a plan view of a type carrier or type wheel.
Figure 2B:
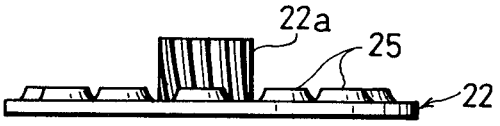
Figure 2C:
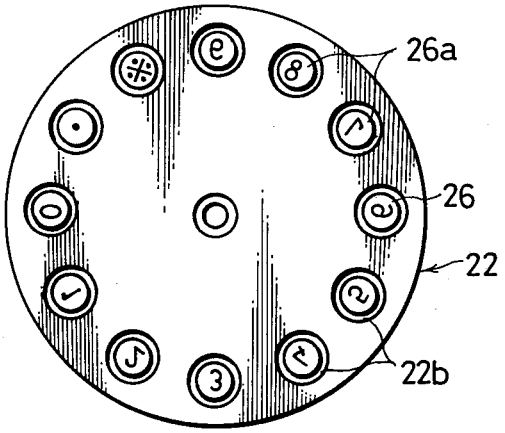
Figure 4:
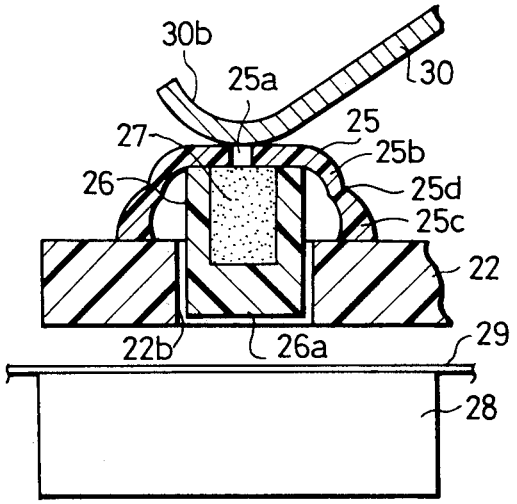
FIGS. 4(*a*) and 4(*b*) are partly enlarged sectional view of the type wheel for explaining the printing operation of the printer of the invention.
Figure 4B:
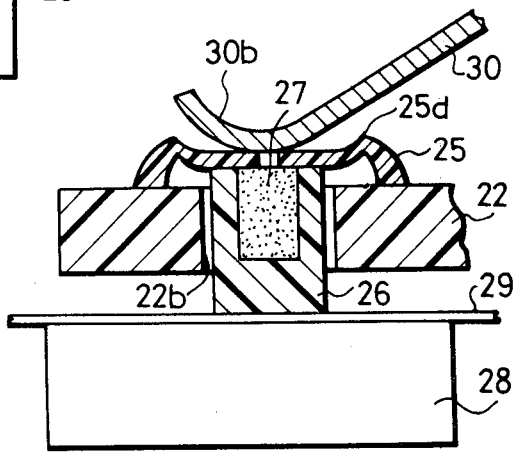

The type carrier 22, as shown in FIGS. 2(*a*) to 2(*c*), is provided on its periphery with a plurality of apertures 22*b* formed at equal intervals therearound. Each aperture 22*b* is covered by a dome-shaped resilient support member 25 which is secured at its peripheral edge to the type carrier 22 by a suitable means such as bonding. The cover member 25 is made of a resilient plastic material. If the type carrier 22 is formed of a plastic, it is possible to form the two parts 22,25 integrally with each other by a suitable selection of the shaping material. A type member 26 is fixed to the reverse side of the top of each supporting member 25 as shown in FIG. 4(*a*). The type member is positioned within the aperture 22*b* and is provided at its end with a predetermined type character 26*a* (See FIG. 2(*c*)). The above-mentioned type member 26 is formed of a porous plastic which can be impregnated with ink, and is adapted to be supplied with ink from an ink supply member 27 (See FIG. 4) in the type member 26.

A reference numeral 25*a* designates a hole formed in the top of the supporting member 25. The arrangement is such that the ink is fed to the ink supply member through this hole 25*a*.

The ink with which the type member is impregnated can be changed according to the nature of the type members. For instance, by using blue and red ink for the numeral types and for the function types, respectively, it is possible to discriminate the type data more easily.

As the supporting member 25 is pressed at its top portion, it is deflected as shown in FIG. 4(*b*) to force the type member 26 out of the aperture 26 by a predetermined amount to lightly press the type character 26*a* of the type member 26 against the paper 29 positioned on an anvil or platen 28 to effect the printing of the desired character. It is to be noted that, the member 25 is configured in such a manner that a part of the top of the supporting member is instantaneously inverted and deformed by a snap action as it is depressed by a predetermined stroke to make the type character 26*a* of the type member 26 project from the aperture 22*b* by a predetermined amount so as to press the type character 26*a* lightly on the paper 29. The supporting member soon resumes the state shown in FIG. 4(*a*) as it is relieved from the depressing force. Therefore, the amount of movement of the type member 26 is maintained constant to ensure a uniform quality of the printing. In addition, the level of noise is remarkably reduced because the impacting force applied to the paper 29 is so small. Furthermore, this arrangement permits a printing on papers having a comparatively large thickness such as cards, envelopes and so forth.

The supporting member 25 acting as a snap action dome can have various forms. In the described embodiment, as will be understood from FIG. 4(*a*), the supporting member 25 has two-staged dome shape consisting of an upper dome 25*b* and a lower dome 25*c* with a node 25*d* therebetween, so that the upper dome 25*b* above the node 25*d*, having a comparatively large amount of deformation is inverted, while the resilient force of the lower dome 25*c* contributes to the resetting of the upper stage dome after the inversion.

A hammer member (pressing means) 30 for pressing the supporting member 25 is supported, as shown in FIGS. 1 and 3, by the support shaft 31 extending between the attaching pieces 19*c*,19*c* integrally bent outwardly from the central portion of the carriage 19, and is always biased in the direction of arrow A in FIG. 3 by a leaf spring 32 held by the attaching pieces 19*c*,19*c*. As a result, the hammer member 30 is always kept in contact at its one end 30*a* with the cam 13. As the cam 13 rotates at a high speed, the hammer member 30 is rotated in the direction opposite to the arrow A overcoming the force of the leaf spring 32, thereby to instantaneously depress the top of the supporting member 25 at the other end 30*b* thereof.

Referring back to FIG. 1, a reference numeral 33 designates a reset spring which is secured at its one end to the carriage 19 and at the other end to the frame 2B and adapted to reset the carriage 19. The reset spring spring 33 always continuously pulls the carriage 19 rightwardly as viewed in FIG. 1, i.e. toward the home position. The arrangement is such that, when the carriage 19 is to be moved to the home position, the rack 18 is rotated to come out of engagement with the second worm 21, thereby to permit the carriage to be quickly returned to the home position. On the other hand, the rack 18 is normally biased rotatively in the direction of arrow B in FIG. 3 by a spring (not shown) so as to be stopped by a stopper 34 where it meshes with the worm 21 to perform the shifting of the carriage 19 and holding of the same as the worm 21 is rotated.

Referring to FIG. 3, a solenoid 35 is adapted to attract an attractable member 18*a* of the rack 18 to disengage the rack 18 from the second worm 20 to permit the resetting of the carriage 19.

In FIG. 3, reference numerals 36,37 denote rollers for feeding the paper.

The serial printer of this embodiment having the construction heretofore described operates in a manner explained hereinunder.

In preparing for the start of the printing of one line, the carriage 19 is positioned at the rightmost position in FIG. 1, the rack 18 is then brought into engagement with the second worm 21, and the operation rod 9 of the solenoid 8 is pressed by a spring into engagement with the cam groove 7*a* of the second clutch means 7. In this state, the torque of the motor 10 can be transmitted to the type wheel shaft 1 and the ratchet 3 through a gear 4 and a first clutch means 6.

As the motor 10 rotates in this state, the type wheel shaft 1 is rotated to rotate the type carrier 22 by the rotation of the first worm 20 on the shaft 1. The solenoid 8 is then actuated in accordance with the instruction to permit the operation rod 9 to be disengaged from the cam groove 7*a* of the second clutch means 7. At the same time, the operation rod 9 is brought into engagement with the ratchet 3 to disengage the first clutch means 6 (state of no torque transmission) and disconnected the type wheel shaft 1 and the motor 10. In consequence, the rotation of the type wheel shaft 1 is stopped so that the type carrier 22 is stopped with the desired type character positioned oppositely the pressing portion 30*b* of the hammer member 30.

The energization of the solenoid 8 for selecting the type character is made only temporarily. As the operation rod 9 comes out of engagement with the cam groove 7*a* of the second clutch means 7, the rotation of the motor 10 is transmitted without delay to the second clutch means 7 and the gear 5 through the gear 4. As a result of the rotation of the second clutch means 7, the operation rod 9 which is biased toward the latter is made to resiliently press the outer peripheral surface of the cylinder of the second clutch means 7. The operation rod 9 is kept in engagement with the ratchet 3 until the cam groove 7*a* of the second clutch means 7 is brought opposite to the operation rod 9 to receive the latter, so that the first clutch means 6 is disengaged while the second clutch means 7 is disengaged, i.e. in the state for the transmission of torque.

In consequence, the type carrier 22 is stopped in such a state that the supporting member 25 mounting the desired type character 26 is positioned to oppose the pressing portion 30*b* of the hammer member 30. Meanwhile, the torque of the motor 10 is transmitted to the gear 5 to drive the gears 16 and 14 meshing with the latter, thereby to rotate the hammer drive shaft 12 and the column shift shaft 15 in synchronism.

As the hammer driving shaft 12 is rotated, the projection 13*a* (See FIG. 3) of the hammer driving cam 13 presses one end 30*a* of the hammer member 30 to rotate the latter around the axis of the support shaft 31 in the counter-clockwise direction as viewed in FIG. 3.

In consequence, the pressing portion 30*b* of the hammer member 30 depresses the top of the supporting member 25 to press the type member 26 attached to the reverse side of the supporting member 25 against the paper 29 as shown in FIG. 4(*b*) to print the desired character at the endmost position on the paper 29.

Meanwhile, the column shift shaft 15 and the and the hammer drive shaft 12 are rotating. However, in the earlier half of the rotation of the column shift shaft 15, the spiral teeth of the second worm 21 do not engage the rack 18. The spiral teeth of the second worm 21 comes into engagement with the rack 18 in the later half of the rotation of the column shift shaft 15, which is after the completion of rotation of the hammer member 30 and resetting of the hammer member 30 and the supporting member 25 (type character 26) to the position shown in FIG. 4(*a*). In consequence, the carriage 19 is moved to the left as viewed in FIG. 1 by a distance corresponding one pitch along the column, overcoming the force of the coiled spring 33.

After the completion of the driving of the hammer member 30 and the shift of the carriage 19 by one pitch, i.e. after the completion of one full rotation of each of the hammer drive shaft 12 and the column shift shaft 15, the second clutch means 7 rotating in synchronism with these shaft has made a half rotation to bring the cam groove 7*a* thereof to the position where the latter opposes to the operation rod 9. As a result, the spring loaded operation rod 9 drops into the cam groove 7*a* and is disengaged from the ratchet 3 to engage the first clutch means 6 while disengaging the second clutch means 7. In consequence, the rotation of the motor 10 is transmitted only to the type wheel shaft 1 to rotate the type carrier 22.

In this state, the solenoid 8 can be energized by a printing instruction in the same manner as stated before, to effect the selection of the type character and the driving of the hammer 30, to print on the position second from the endmost. Thereafter, the carriage 19 is further shifted by one pitch to the upper place. The cyclic operation including the selection of type character, driving of the hammer member 30, and the shifting of the carriage by one pitch is made repeatedly to effect the printing on successive positions on the same line.

After the completion of one printing in one line, the aforementioned solenoid 35 is energized by the issue of a carriage return instruction, so that the rack 18 is attracted and rotated in the direction of the arrow B in FIG. 3 to disengage the rack 18 from the second worm 21. In consequence, the carriage 19 is rapidly reset to the home position by the tension of the coiled spring 33. The solenoid 35 is de-energized after the resetting of the carriage 19 so that the rack 18 is made to engage with the second worm 21 by the action of the spring. Meanwhile, a power source for the paper feed (not shown) feeds the paper to permit the printer to prepare for the printing in the next line.

The above-described operation is repeated for successive lines to effect the printing of the desired data. In the described embodiment, the printing operation and the column shift operation are made in relation to each other without fail. Therefore, it is advisable to provide the type carrier 22 with a blank so that, when it is requested to make a blank in a line, the blank portion, i.e. a supporting member 25 having no type character, is positioned to oppose to the hammer member 30 thereby to effect the printing operation.

In the illustrated embodiment, the type carrier 22 is illustrated to carry only 12 (twelve) type characters 26 for the purpose of clarification of the drawings. Actually, however, the type carrier 22 carries many more type characters.

As has been described, according to the invention, there is provided a serial printer in which the type elements are attached to the reverse side of dome-shaped supporting members covering apertures in the disc-shaped type carrier, so that a type supplied with ink may be lightly pressed against the paper to effect printing, as the top surface of the supporting member is pressed. Therefore, the level of the noise during printing is remarkably reduced. In addition, since the printing is effected directly by the type using an ink, it is possible to obtain a highly clean printing on the paper. The dome-shaped supporting member can be formed as a snap dome. By so doing, it is possible to obtain a constant amount of projection of the type character irrespective of the change in the pressing force of the hammer and the stroke of the same, to further constibutes to the improvement in the printing quality.

Furthermore, according to the invention, the serial printer of carriage shifting type in accordance with the invention can have a simple and flat construction which in turn enhances the utility of the printer.

In addition, partly because the selection of the type, driving of the hammer and the shifting of the carriage can be performed by a single D.C. motor, and partly because the driving power source for driving the hammer member carried by the carriage is not mounted on the latter, the size and weight of the carriage is considerably reduced.

Thus, according to the invention, it is possible to obtain a small, light and less expensive serial printer having reduced number of the driving power source, suitable for use in combination with a desk-top type calculator, while preserving the advantage of the printer of the type concerned, i.e. the capability of accomodation of comparatively large number of type characters on a single type carrier.

What is claimed is:

1. A type wheel for a serial printer including a disc-shaped member having a plurality of apertures spaced circumferentially around the outer portion thereof, a plurality of dome members each covering a respective aperture and formed of a resilient material enabling each dome member to be deflected inwardly toward the respective aperture by a snap action substantially instantaneously upon application of a sufficient pressing force and then to be returned to its initial position by its resilience, and a plurality of type elements each connected with the inner surface of a respective dome member and movable out of the plane of said disc-shaped member upon inner deflection of the respective dome member.

2. A serial printer including:

a carriage movable along a line to be printed and carrying a type wheel formed by a disc-shaped member having a plurality of apertures spaced circumferentially around the outer portion thereof, said type wheel further including a plurality of respective dome members each covering a respective aperture and formed of a resilient material enabling each dome member to be deflected inwardly toward the respective aperture by a snap action substantially instantaneously upon application of a sufficient pressing force and then to be returned to its initial position by its resilience, and a plurality of type elements each fixed to the inner surface of a respective dome member and movable out of the plane of said disc-shaped member upon inner deflection of the respective dome member;

means connected to said type wheel for rotating it to bring a selected type element into a printing position;

means for moving said carriage along the line to be printed;

a hammer member held pivotally to said carriage, and means for pivoting said hammer member to cause it to apply said pressing force.

3. A device according to either claim 1 or 2, further including means including an ink impregnable member included within each said dome member for supplying ink to the type elements.

4. A device according to claim 3, said type elements being porous to ink and said ink impregnable members being held within the inner portion of the respective type element.

5. A device according to claim 4, said dome members each including an opening leading to the respective ink impregnable members.

6. A serial printer according to claim 2, said carriage being slidable along a rotary shaft and said type wheel rotating means including meshing gears formed respectively on said rotary shaft and said type wheel.

7. A serial printer according to claim 6, said means pivoting said hammer member including a fixed cam member extending along the entire line to be printed and adapted to be rotated about an axis parallel to the line to be printed, a spring member urging said hammer member into engagement with said cam member and means to rotate said cam member to pivot said hammer member to apply said pressing force regardless of the position of said carriage along the line to be printed.

8. A serial printer according to claim 7, including a single motor connected to rotate said rotary shaft and said cam member, and a clutch mechanism for connecting either said rotary shaft or said cam member to said motor, said motor being adapted to rotate unidirectionally in only a single direction.

9. A serial printer according to claim 2, said means pivoting said hammer including a fixed cam member extending along the entire line to be printed and adapted to be rotated about an axis parallel to the line to be printed, a spring member urging said hammer member into engagement with said cam member and means to rotate said cam member to pivot said hammer member to apply said pressing force regardless of the position of said carriage along the line to be printed.

10. A serial printer according to claim 2, said carriage being slidable along a rotary shaft and said type wheel rotating means receiving rotational torque from said rotary shaft, said carriage further including a spring element urging it towards its initial position along a line to be printed; said carriage moving means including a second rotary shaft; a motor connected to rotate said rotary shafts and adapted to rotate unidirectionally in only a single direction; and a clutch mechanism for connecting either of said rotary shafts to said motor.

11. A serial printer including:

a carriage slidable along a first rotary shaft extending parallel to a line to be printed and carrying a type wheel having a plurality of type elements;

means interconnecting said type wheel and said first rotary shaft for rotating said type wheel to bring a selected type element in a printing position;

a hammer member held pivotally to said carriage, and means for pivoting said hammer member to cause it to apply a pressing force to the selected type element, said pivoting means including a fixed cam member extending along the entire line to be printed and adapted to be rotated about an axis parallel to the line to be printed and means including a hammer drive shaft to rotate said cam member for applying said pressing force regardless to the position of said carriage along the line to be printed;

means for moving said carriage along said line to be printed;

a motor; and means including a clutch mechanism operated by a solenoid to end the rotation of said first rotaty shaft to bring the desired type element in said printing position while rotating said cam member to apply said pressing force by said hammer member and then actuate said carriage moving means.

12. A serial printer according to claim 11, said motor being adapted to rotate unidirectionally in only a single direction.

* * * * *